US005123699A

United States Patent [19]

Warburton

[11] Patent Number: 5,123,699

[45] Date of Patent: Jun. 23, 1992

[54] PORTABLE, CUSTOMIZED PATIENT SUPPORT SYSTEM WITH DETACHABLE BOTTOM BACK AND SIDE CUSHIONS AND METHOD OF USING

[76] Inventor: Patricia G. Warburton, 9289 W. Baltic Dr., Lakewood, Colo. 80227

[21] Appl. No.: 682,634

[22] Filed: Apr. 9, 1991

[51] Int. Cl.[5] ..... A47C 27/00

[52] U.S. Cl. ..... 297/219; 297/256; 297/223; 297/458; 5/464

[58] Field of Search ..... 297/284 C, 284 D, 284 G, 297/219, 229, 485, 464, 467, 488, DIG. 1, 458, 459, 118, 250, 254, 255, 256, 443, 444, 382, DIG. 4, 223, 487; 5/431, 432, 433, 447, 446, 464, 465, 481

[56] References Cited

U.S. PATENT DOCUMENTS

| | | | |
|---|---|---|---|
| 1,934,615 | 11/1933 | Selverstone | 297/229 |
| 2,557,874 | 6/1951 | Kailenta | 297/256 |
| 2,829,707 | 4/1958 | Liebson . | |
| 3,205,010 | 9/1965 | Schick | 297/458 |
| 3,316,018 | 4/1967 | Stith . | |
| 3,503,649 | 3/1970 | Johnson | 297/459 |
| 3,973,800 | 8/1976 | Kogan . | |
| 4,155,126 | 5/1979 | Classen . | |
| 4,234,228 | 11/1980 | Flamm . | |
| 4,306,750 | 12/1981 | Wenger et al. . | |
| 4,441,221 | 4/1984 | Enste et al. | 297/118 X |
| 4,522,447 | 6/1985 | Snyder et al. | 297/DIG. 1 X |
| 4,568,125 | 2/1986 | Sckolnik | 297/467 |
| 4,643,481 | 2/1987 | Saloff et al. . | |
| 4,647,066 | 3/1987 | Walton . | |
| 4,753,480 | 6/1988 | Morell | 5/464 X |
| 4,753,482 | 6/1988 | Warren | 297/459 X |
| 4,819,286 | 4/1989 | Beauchamp | 5/431 |
| 4,854,638 | 8/1989 | Marcus et al. . | |
| 4,912,788 | 4/1990 | Lonardo . | |
| 4,925,244 | 5/1990 | Nava . | |

FOREIGN PATENT DOCUMENTS

| | | | |
|---|---|---|---|
| 975136 | 11/1964 | United Kingdom | 297/218 |
| 1399285 | 7/1975 | United Kingdom | 297/284 |
| 2181642 | 9/1985 | United Kingdom . | |
| 2205235 | 12/1988 | United Kingdom | 297/467 |

*Primary Examiner*—Kenneth J. Dorner
*Assistant Examiner*—James M. Gardner
*Attorney, Agent, or Firm*—Sheridan Ross & McIntosh

[57] ABSTRACT

A portable, customized patient support system is provided for maintaining a person in a substantially upright sitting position. The system has a seat cushion, a back cushion and left and right lateral trunk brace cushions. Each of the cushions is selected to conform to certain measured dimensions of the person. The cushions are secured to each other using interconnecting devices. The assembled system can be used with most conventional chairs and seats, including wheelchairs. A method of providing support for a person in a substantially upright sitting position is also provided which includes the steps of measuring certain dimensions of the patient, selecting appropriately sized cushions and securing the cushions together using the interconnecting devices.

5 Claims, 7 Drawing Sheets

PORTABLE, CUSTOMIZED PATIENT SUPPORT SYSTEM WITH DETACHABLE BOTTOM BACK AND SIDE CUSHIONS AND METHOD OF USING

FIELD OF THE INVENTION

The present invention relates to a device for maintaining a person in a substantially upright sitting position, and particularly to a portable, customized support system that can be used with conventional chairs and seats including wheelchairs.

BACKGROUND OF THE INVENTION

It is widely recognized that proper posture is important to the general well being of an individual. When sitting, a person's back should be substantially vertical and slightly arched in the lumbar region. This aids blood circulation and digestion, reduces muscle fatigue and reduces pressure on nerves. Proper posture also helps prevent hypostatic pneumonia by providing sufficient room in the chest cavity to permit the lungs to fully expand. Elderly, infirm and physically impaired patients often have difficulty maintaining a proper sitting position in a chair and may tend to slip, lean or slump unless restrained. One common practice used to alleviate this problem is to strap the patient into the chair with belts or a harness. While such a practice may keep the patient in the chair and may be convenient for the person attending the patient, the practice has serious drawbacks. First is the patient's loss of dignity from being strapped into a chair. Second, the patient, although upright, may have improper posture, potentially leading to muscle, nerve or blood circulation problems or to hypostatic pneumonia. Third, if the restraining belts are too tight, the may suffer discomfort, bruises or impaired blood circulation. On the other hand, if the belts are too loose, the patient may lean to one side, slump forward, or worse, slide down under the belts. If the slide is not stopped, the patient's neck can catch on one of the belts and the patient strangle to death. Although not well publicized, such incidences are not rare, particularly in nursing home environments.

One attempt to provide support to physically impaired patients is a large orthopedic chair disclosed in U.S. Pat. No. 4,647,066 to Walton issued Mar. 3, 1987 and entitled "Orthopedic Chair". The chair includes a seat, a back rest, arm rests, foot rests and a tray, each of which is adjustable in a number of ways to provide support which is appropriate for a particular patient. The chair also has wheels and a rear handle so that it can be pushed from one place to another.

U.S. Pat. No. 4,234,228 to Flamm issued Nov. 18, 1980 and entitled "Modular Articulating Seating System For The Handicapped" discloses and orthopedic seat which resembles a large infant car seat. Support is provided for the patient's hips, torso, shoulders and head. Numerous pads of different thicknesses are employed in a shell which has several adjustable pivot points. An abductor is included with the seat cushion. The chair is said to be particularly well suited to patients having a variety of serious muscular or spinal disorders.

Such existing seats tend to be bulky which inhibits or prevents their use with existing chairs (such as with wheelchairs, ordinary table chairs or an automobiles). Furthermore, adjusting them can be time consuming and complicated and require the services of highly trained personnel to fit a patient. Other existing seats provide no adjustments and may be comfortable, if at all, only to a few "average" patients. Additionally, many of the existing devices are complicated and expansive, designed primarily for those with serious impairments. These are not well suited for typical nursing home or home-care patients who do not have major muscular or spinal disorders, but who simply have trouble maintaining an upright sitting position in a chair.

Portable devices for use in a wheelchair have been devised but they do not provide the complete support that is required for certain invalid patient. U.S. Pat. No. 4,643,481 to Suloff et al. issued Feb. 17, 1987 and entitled "Seat System For Preventing Decubiti" discloses a base and cushion adopted to be used with a wheelchair. The cushion is tapered to achieve desired support. A system that includes both a seat cushion and a lumbar cushion is disclosed in U.S. Pat. No. 4,912,788 issued Apr. 3, 1990 to Lanardo entitled "Seat Pad For Invalid Patients."

Despite the variety of proposed devices, it would be advantageous to provide a simple, lightweight support system to help patients maintain proper posture in an upright sitting position in an existing chair and which is both customizable for each patient and highly portable. It is also desirable that the support system be relatively inexpensive and have parts that can be quickly selected and assembled by someone having only a relatively small amount of specialized training.

SUMMARY OF THE INVENTION

In accordance with the present invention, a portable support system is provided for maintaining a person in a substantially upright sitting position. The system includes a seat cushion for supporting the weight of a seated person, a back cushion for supporting the person's back in a substantially upright position, and left and right lateral trunk brace (side) cushions for supporting the sides of the person's torso in substantially upright position. Each of the four cushions is provided in a variety of different dimensions allowing the cushions to be combined and assembled to provide customized seating for most people.

Prior to assembling the system, certain dimensions of the person who will be using the system (hereinafter referred to as "patient", although this should not imply that the support system can only be used by individuals who are confined to a hospital or a nursing home) are measured and the patient's condition and needs are evaluated. Based on the measurements obtained, appropriately sized seat, back and side cushions are selected. The back cushion is secured to the seat cushion and the side cushions are secured to the seat and back cushions. The connections are preferably readily accomplished to facilitate assembly of the cushions into the complete support system.

The assembled support system is connected to or placed on any conventional chair (such as a wheelchair, a table chair or an automobile seat) and the patient is seated in the support system. The system helps direct the patient's body to maintain proper posture in a substantially upright seated position.

The support system of the present invention is lightweight and portable, making it easy to move from one chair or location to another as the patient moves. It is customizable to accommodate substantially all patients and achieve the desired patient comfort. The system is also easily assembled using the four interchangeable pieces.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The preferred embodiment of the present invention is best understood by referring to 1–7 of the drawings, like numerals being used like and corresponding parts of the various drawings.

Figure 1:
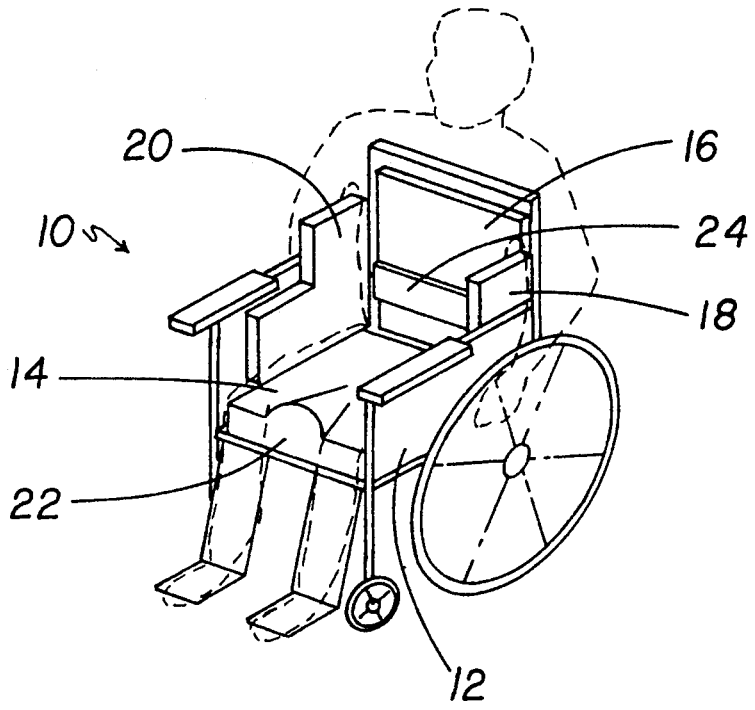
FIG. 1 illustrates the use of the present invention by a patient in a wheelchair.

FIG. 1 illustrates the use of the support system 10 of the present invention by a (shown in phantom) in a wheelchair 12. Support 10 includes a seat cushion 14 for supporting the of the seated patient, a back cushion 16 for back of the patient, a left lateral trunk brace 18 and a right lateral trunk brace cushion 20 for supporting the left and right sides of the patient's torso, respectively. Support system 10 can be used with conventional support units other than 12, such as conventional chairs, sofas and automobile seats. The system 10 can also be moved from chair to chair as the patient moves from one location to another.

In use, the patient sits in support system 10 with his or her arms positioned outside of left and right lateral trunk brace cushions 18 and 20. Seat cushion 14 includes a saddle abductor wedge 22 for separating the patient's legs and helping prevent unwanted forward movement of the patient. Back cushion 16 includes a lumbar support section 24 positioned with back cushion 16 and at a predetermined distance from the bottom of the back cushion 16. Lumbar support section 24 helps maintain the patient's back in a slightly arched position, further promoting proper posture. As will be explained in more detail below, other features of support system 10 urge the patient's buttocks toward the back of seat cushion 14 and urge the patient's back firmly against back cushion 16.

Figure 2:
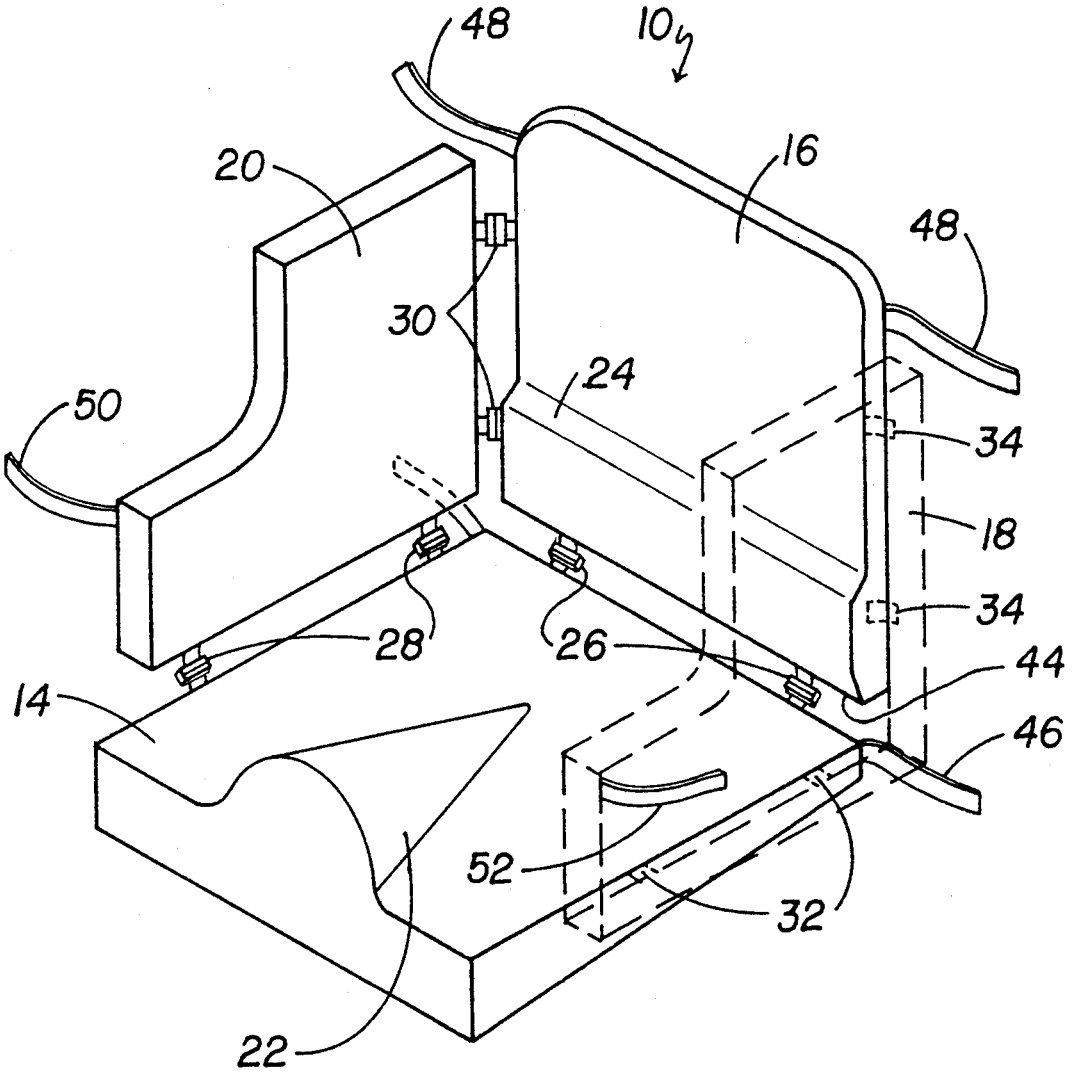
FIG. 2 illustrates the assembled cushions of the present invention.

FIG. 2 represents a detailed illustration of support system 10 with left lateral trunk brace cushion 18 shown in phantom. Back cushion 16 is attached to seat cushion 14 using interconnecting devices 26. Right lateral trunk brace cushion 20 is attached to seat cushion 14 using interconnecting devices 28 and is attached to back cushion 16 using interconnecting devices 30. Left lateral trunk brace cushion 18 is attached to seat cushion 14 using interconnecting devices 32 and is attached to back cushion 16 using interconnecting devices 34. All such interconnecting devices 26, 28, 30, 32 and 34 are preferably the same in construction and each includes conventional mating members and straps.

Figure 3:
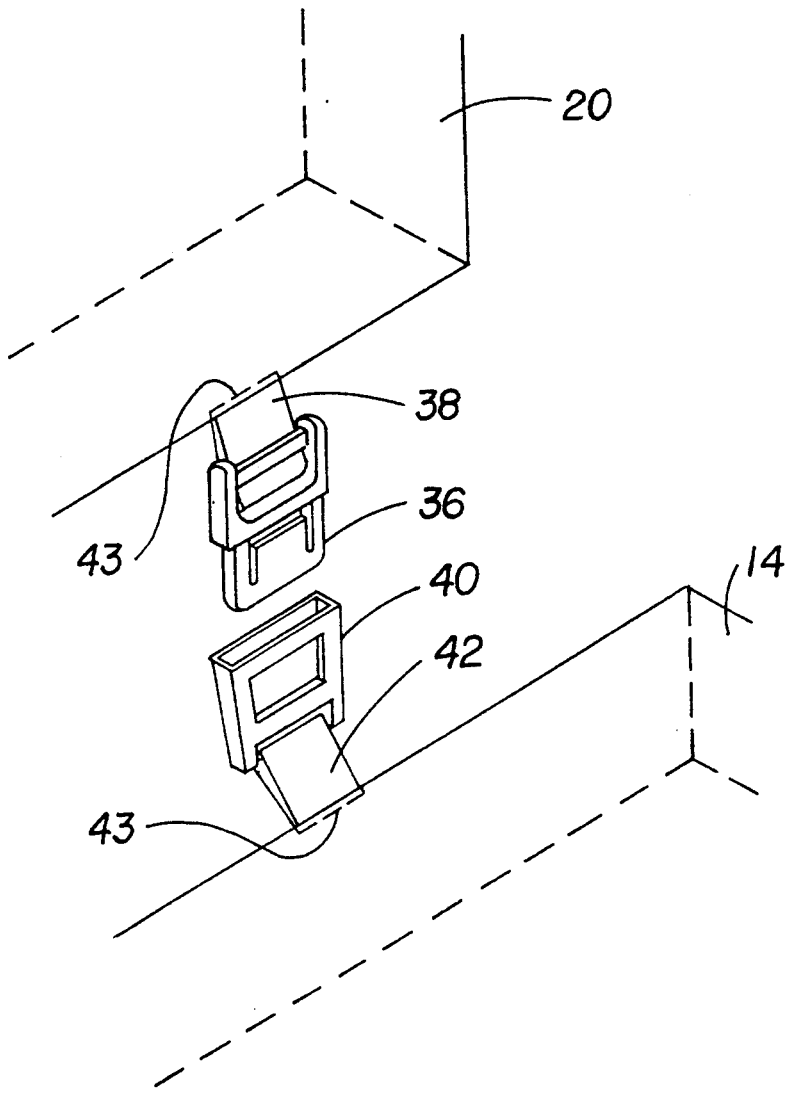
FIG. 3 illustrates an enlarged view of an interconnecting device connecting the seat cushion and one of the lateral trunk brace cushions.

With reference also to FIG. 3, each interconnecting device includes a male clip 36 and a male strap 38 connected thereto. Each device further includes a female clip 40 and a female strap 42 connected thereto. Each of the straps is attached to narrow sides of the cushions, preferably, along cushion seams 43 to facilitate the attachment between cushion and straps. In the case of the seat cushion 14, the straps are attached to upper edges of the relatively narrow sides thereof. The straps associated with fastening the back cushion 16 to the left and right lateral trunk brace cushions 18, 20 are attached about in the middle narrow sides along the length thereof. Those back cushion straps that are used in conjunction with interconnecting the seat cushion 14 to the back cushion 16 are located along the narrow bottom side of the back cushion 16 at the inside edge thereof. In the case of the straps attached to the left and right lateral trunk brace cushions 18, 20, they are connected to the seams thereof along the inside edges of the narrow sides thereof. Such positioning of the straps associated with the left and right lateral trunk brace cushions 18, 20 permits the male or female clips to which they are attached to be more easily and practically interconnected with the particular mating clip joined to the cushion 14 or back cushion 16. To interconnect male and female clips 36, 40, the male clip 36 is removably snapped to the female clip 40. As can be seen in FIG. 2, after the cushions have been assembled together, spaces or gaps 44 are formed between each of the interconnected cushions. The spaces 44 facilitate positioning of the assembled system 10 with the conventional separate support unit, such as a wheelchair 12, and are a further aid in providing a customized fit and comfort to the particular patient who is to use the support system 10. The clip arrangement also results in easy assembly of the various cushions into a complete support system and allows the support system to be readily disassembled for cleaning, transporting or replacement of cushions.

As also seen in FIG. 2, long straps 6 attached to the back corners of seat cushion 14, long straps 48 attached near the upper corners of back cushion 16, long strap 50 attached to a front portion of right lateral trunk brace 20 and long strap 52 on a front portion of left lateral trunk brace 18 can be used to secure support system 10 to a chair. Long straps 46, 48, 50 and 52 are, for example, strips of Velcro TM and can be attached to a convenient location on the chair. Such straps can easily be separated to enable support system 10 to be removed from the chair.

Figure 4:
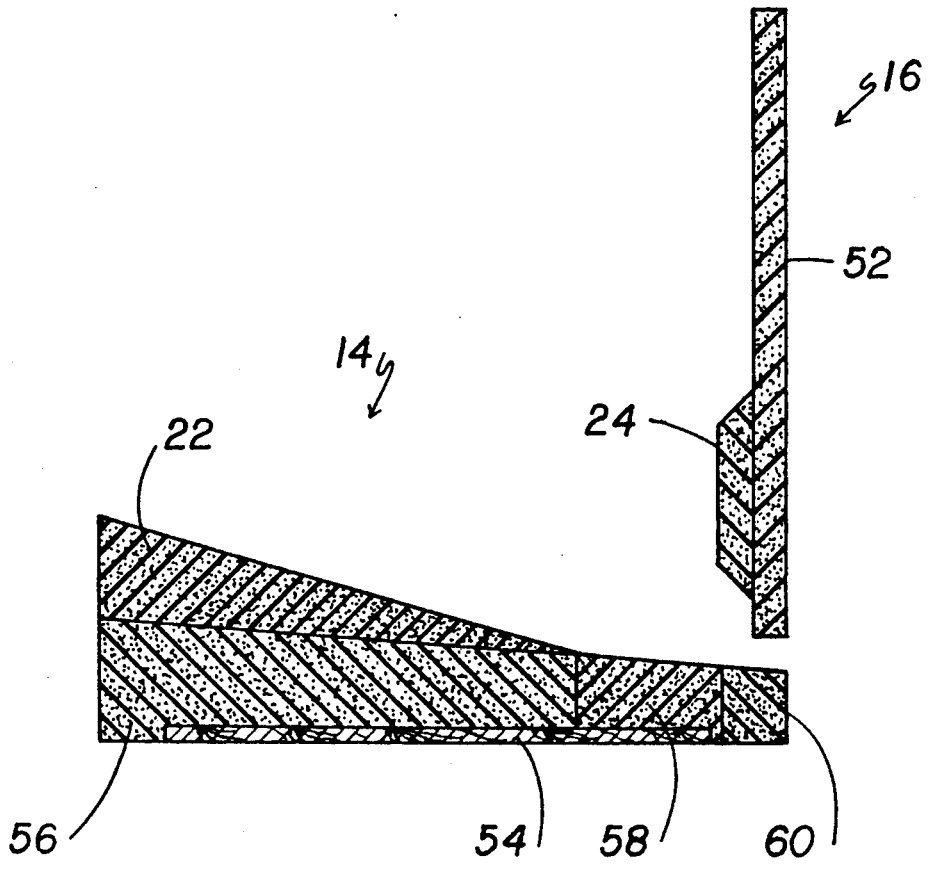
FIG. 4 illustrates a cross-sectional view of seat and back cushions of the present invention.

FIG. 4 illustrates a cross-sectional view of seat cushion 14 and back cushion 16 of support system 10. Seat cushion 14 includes a rigid seat board 54 underlying substantially all of seat cushion 14. The balance of seat cushion 14 includes several densities of foam material located at various positions. A front seat section 56, comprising approximately the front 4/5ths of seat cushion 14, includes a foam of about 2.5 pounds density. Abductor wedge 22, above front seat section 56, includes a foam material of about 2 pounds density. A center seat section 58 includes foam material of about 1.1 pounds density. A rear seat section 60 includes a foam of about 2.5 pounds density.

In a seat cushion 14 having a depth of approximately 18 inches (which would fit onto a typical wheelchair seat), front seat section 56 has a length of about 15 inches, center seat section 58 has a length of approximately 2 inches and rear seat section 60 has a length of approximately 1 inch. Such an arrangement of foam densities provides comfortable support for the patient's ischial bones. It also urges the patient's body towards the rear of support system 10 and helps prevent the patient from slumping forward. Furthermore, the top surface of seat cushion 14, excluding abductor wedge 22, slopes down from the front to the back further causing the patient to be urged toward the back of support system 10 to more firmly hold the patient's back against back cushion 16. In one embodiment, the front of seat cushion 14 is three inches high and the back of rear seat section 60 is two inches high.

Back cushion 16 also includes different densities of foam material. Lumbar support section 24 includes a foam material of about 2.5 pounds density. The balance of back cushion 16 includes foam material of about 1.8 pounds density.

Figure 5:
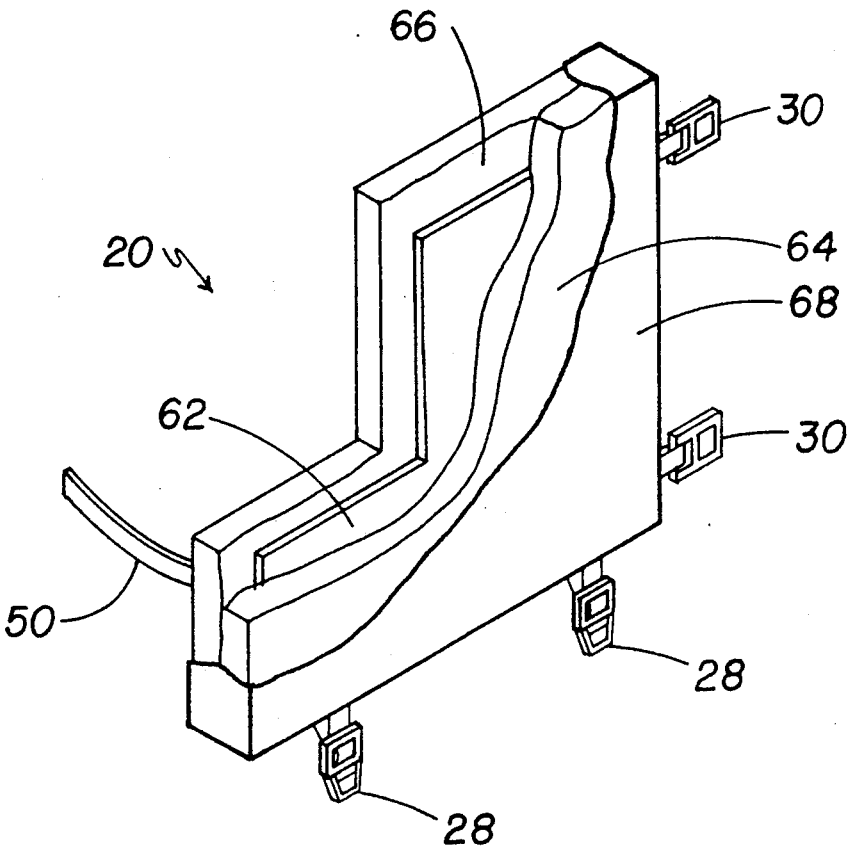
FIG. 5 illustrates a cut-away view of a right lateral trunk brace cushion of the present invention.

FIG. 5 illustrates a cut-away view of right lateral trunk brace 20. It includes a thin rigid board 62 of a lightweight material, such as a material identified by the trademark MASONITE. Surrounding rigid board 62 is an inside foam material 64 and an outside foam material 66. Preferably, inside foam material 64 and outside foam material 66 each are about 1.1 pounds density and are each about four inches thick. When covered with a cushion cover 68, inside foam material 64 and outside foam material 66 are each compressed to a thickness of about two inches. For comfort, rigid board 62 does not extend the full length and height of right lateral trunk brace 20 and thus does not create any direct pressure on any portion of the patient's body. Cushion cover 68 can be any conventional seat material but is preferably a water resistant, easily cleaned and lightweight material, such as Naugahyde. Such a material can be used to cover all of the cushions of support system 10. Left lateral trunk brace cushion 18 is essentially the same construction as right lateral trunk brace 20, except that the parts of the interconnecting devices attached to trunk cushion brace 20 are on opposite edges from those of the trunk brace 18 so that they are located along inside edges. Because of this preferable difference, left and right lateral trunk brace cushions 18, 20 are not interchangeable.

Figure 6:
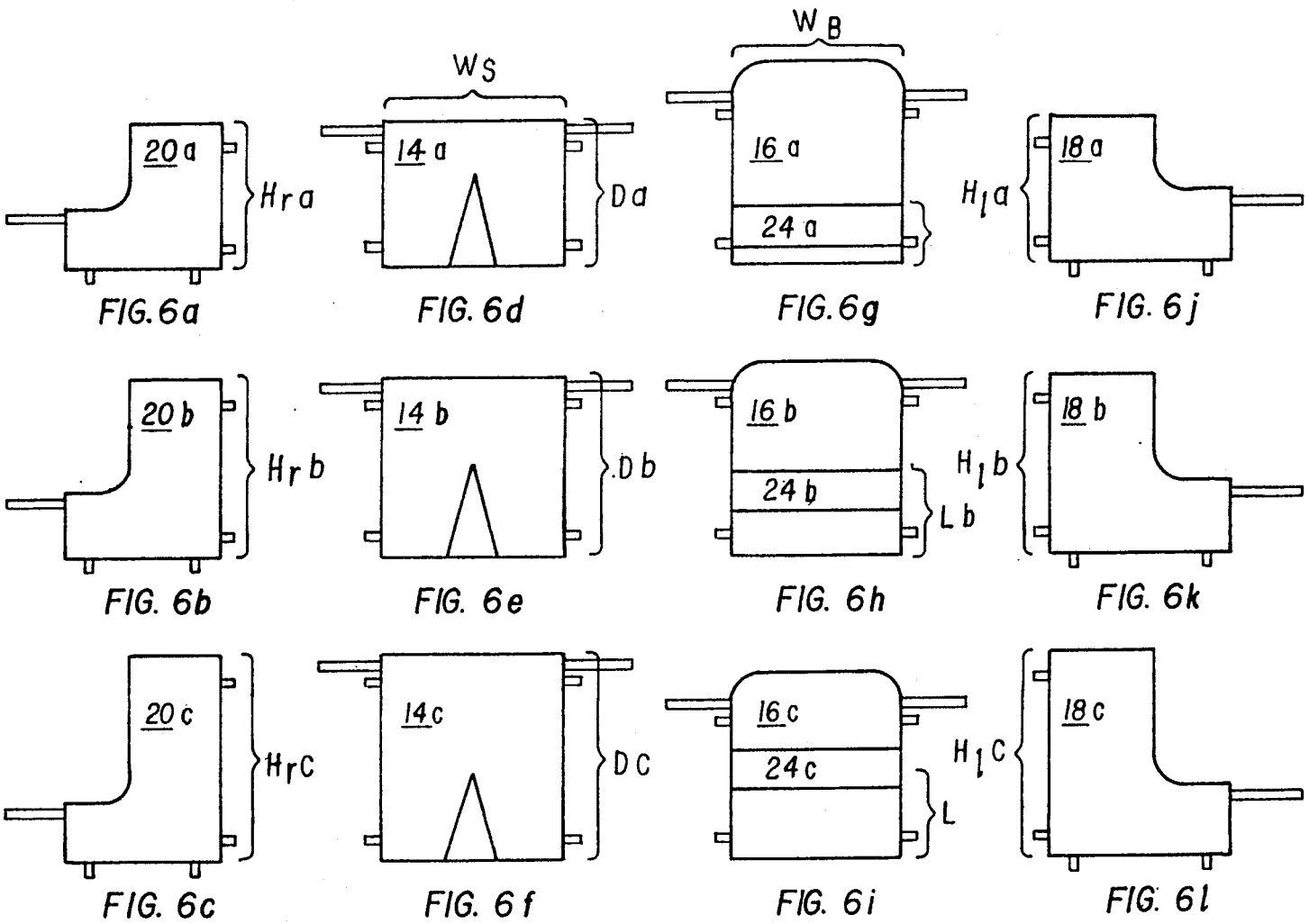
FIG. 6*a*–6*l* illustrate a plurality of differently dimensioned cushions from which appropriate cushions are selected for each patient.
Figure 7:
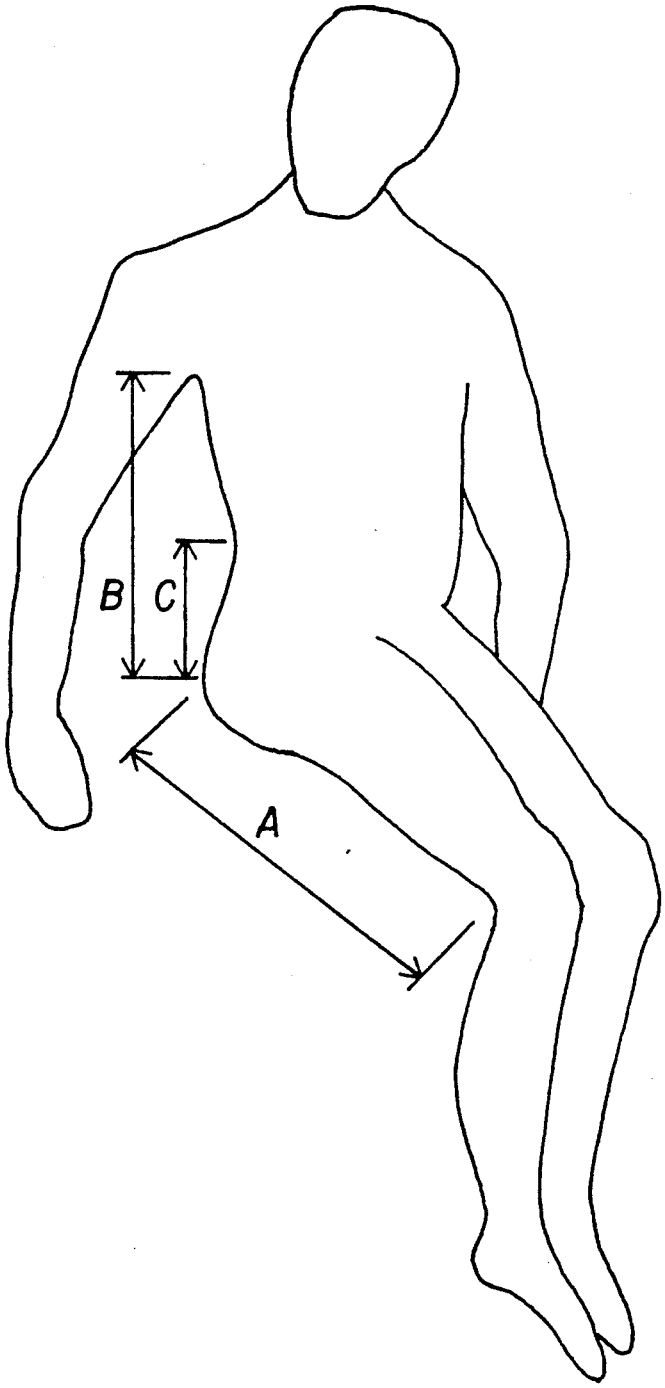
FIG. 7 illustrates dimensions of a patient which are measured before appropriately dimensioned cushions are selected rom those illustrated in FIGS. 6*a*–6*l*.

FIGS. 6*a*–6*l* illustrate an embodiment of the support system 10 of the present invention in which several different right lateral trunk brace cushions 20*a*–20*c*, seat cushions 14*a*–14*c*, back cushions 16*a*–16*c*, and left lateral trunk brace cushions 18*a*–18*c* are available to be selected and assembled for a particular patient. With respect to the illustrated embodiment, the right and left lateral trunk brace cushions 20*a*–20*c* and 18*a*–18*c* and the seat cushions 14*a*–14*c* differ in height from each other while the back cushions 16*a*–16*c* from each other in the position of lumbar support section 24*a*–24*c*. FIG. 7 illustrates dimensions of a sitting patient which are measured in order to select the proper cushions for the customized patient support system 10.

A practitioner, such as an occupational therapist, is trained to evaluate a patient and select and assemble appropriately dimensioned or configured support system cushions. Such training preferably includes learning the importance of proper posture and how a patient can achieve it, learning how to measure and evaluate a patient, learning how to apply the measurements and evaluation to the selection of properly sized elements of the support system, and learning how to assemble the elements into a complete system. The practitioner also learns whether an assembled system provides the proper support for a particular patient and, if not, how to replace one or more cushions to assure a proper fit.

A first dimension which the practitioner measures is the length of the patient's femur, indicated as A in FIG. 7. This is measured from the patient's acetabulum to the patient's knee while the patient is seated. A second dimension which the practitioner measures, indicated as C in FIG. 7, is the distance from the patient's first lumbar vertebra to a flat surface on which the patient is seated. A third dimension which is measured, indicated as B in FIG. 7, is the length of the patient's lateral truck from a flat surface on which the patient is seated to the axilla. In addition to these specific measurements, the practitioner also evaluates the patient for sensorimotor and postural problems and the patient's functional skills. Finally, the practitioner measures the width of the chair or seat which will most often be used by the patient.

Once the patient has been measured and fully evaluated, the practitioner selects appropriate cushions from which the support system is assembled. The height of the left and right lateral trunk brace cushions is preferably equal to about the length of the patient's lateral trunk (dimension B from FIG. 7) minus about three inches. FIGS. 6*a*–6*c* illustrate three right lateral trunk brace cushions 20*a*–20*c* having heights $H_r$a, $H_r$b and $H_r$c and three left lateral trunk brace cushions 18*a*–18*c* having heights $H_l$a, $H_l$b and $H_l$c from which the proper brace cushions can be selected. The heights of right and left lateral trunk brace cushions 20, 18 can be selected so that the patient's right and left arms can easily be positioned to the outside of the lateral trunk brace cushions with no pressure applied to the patient's arms or axilla.

The preferred depth of seat cushion 14 is approximately the femur length A minus at least four inches. FIGS. 6*d*–6*f* illustrate three seat cushions 14*a*–14*c* having lengths Da, Db and Dc. Preferably, the length D should not be so great that front edge of seat cushion 14 causes pressure on the underside of the patient's knees and restricts blood circulation in the patient's legs.

FIGS. 6*g*–6*i* illustrate three back cushions 16*a*–16*c* having lumbar heights La, Lb and Lc for lumbar supports 24*a*, 24*b* and 24*c*, respectively. In a preferred embodiment, lumbar support section 24*a* is 2 inches from the bottom, lumbar support section 24*b* is 3 inches from the bottom and lumbar support section is 4 inches from the bottom of the back cushions 16*a*, 16*b*, 16*c*, respectively. A properly fitted lumbar support section 24 will preferably conform to the small of the patient's back.

The widths $W_S$ and $W_B$ of seat cushion 14 and back cushion 16 are selected so that the assembled support system 10 will fit in or on the chair most often used by the patient. For example, a conventional wheelchair typically has a width of about 18 inches and, therefore, widths $W_S$ and $W_B$ will be about 18 inches. Other widths, although not illustrated in FIGS. 6*a*–6*l*, can be provided and it is not necessary that $W_S$ of seat cushion 14 be the same as width $W_B$ of cushion 16. Additionally, more or fewer than three sizes of each cushion of support system 10 can be made available to the practitioner, and specially dimensioned and manufactured elements can also be provided for a patient with special needs.

Based on the foregoing description, a number of important features of the present invention are readily discerned. A support system is provided to be used with a variety of conventional separate support units, such as a wheel chair. The system is portable so that it is easily carried and adapted to the conventional separate support unit. The system is customized for a particular patient or user by having a number of different seat, back, and brace cushions from which proper cushions for the particular patient can be selected. In selecting the appropriate cushions, it is preferred that measurements be taken of particular body dimensions of the patient. Using such information, the proper cushions are selected. Each of the cushions is easily assembled/disassembled from other cushions. Spaces or gaps are defined between the cushions to further aid in customization and patient comfort. Each of the seat, back and brace cushions is also uniquely constructed to enhance patient support and comfort.

The foregoing description of the invention has been presented for purposes of illustration description. The description is not intended to limit invention to the form disclosed. Consequently, variations and modifications commensurate with the above teachings and the skill or knowledge in the relevant art are within the scope of the present invention. The preferred embodiments described hereinabove is further intended to explain the best mode known of practicing the invention and to enable others skilled in the art to utilize the invention in various embodiments and with the various modifications required by their particular applications or uses of the invention. It is intended that the appended claims be construed to include alternative embodiments to the extent permitted by the prior art.

What is claimed is:

1. A portable support system for maintaining a person in a substantially upright sitting position, comprising:

a seat cushion selected from a plurality of seat cushions with each of said plurality of seat cushions being different, said selected seat cushion being dependent upon physical attributes of the person who is to be supported using the patient support system;

a back cushion selected from a plurality of back cushions with each of said plurality of back cushions being diffferent, said selected back cushion being dependent upon physical attributes of the person who is to be supported using the patient support system;

a first lateral trunk brace cushion for bracing the right side of the person's torso in a substantially upright position, said first lateral trunk brace cushion selected from a plurality of first lateral trunk brace cushions with each of said plurality of first lateral trunk brace cushions being different, said selected first lateral trunk brace cushion being dependent upon physical attributes of the person who is to be supported using the patient support system, said first lateral trunk brace cushion including a substantially stiff material sandwiched between relatively flexible materials;

a second lateral trunk bracing cushion for bracing the left side of the person's torso in a substantially upright position, said second lateral trunk brace cushion being selected from a plurality of second lateral trunk brace cushions with each of said plurality of second lateral trunk brace cushions being different, said selected second lateral trunk brace cushion being dependent upon the physical attributes of the person who is to be supported using the patient support system;

first means for interconnecting said selected seat cushion and said selected back cushion;

second means for interconnecting said selected seat cushion and said selected first lateral trunk brace cushion;

third means for interconnecting said selected back cushion and said selected first lateral trunk brace cushion;

fourth means for interconnecting said selected seat cushion and said selected second lateral trunk brace cushion; and fifth means for interconnecting said selected back cushion and said selected second lateral trunk brace cushion.

2. A system, as claim in claim 1, wherein:

said stiff material terminates at a distance from an upper edge of said back cushion.

3. A portable support system for maintaining a person in a substantially upright sitting position, comprising:

a seat cushion for supporting the weight of a sitting person;

a back cushion for supporting the back of the person in a substantially upright position;

first means for interconnecting said seat cushion and said back cushion;

a first lateral trunk brace cushion for bracing the right side of the person's torso in a substantially upright position;

second means for interconnecting said seat cushion and said first lateral trunk brace cushion;

third means for interconnecting said back cushion and said first lateral trunk brace cushion;

a second lateral trunk brace cushion for bracing the left side of the person's torso in a substantially upright position, each of said first and second lateral trunk brace cushions includes a substantially rigid material sandwiched between layers of substantially flexible material;

fourth means for interconnecting said seat cushion and said second lateral trunk brace cushion; and fifth means for interconnecting said back cushion and said second lateral trunk brace cushion;

wherein each of said cushions is supported by separate conventional support means that includes at least one of the following:

a wheelchair, a chair, a floor surface, a sofa or the like.

4. A portable support system for maintaining a person in a substantially upright sitting position, comprising:

seat cushion means for supporting the weight of the sitting person and including a front side, a rear side, a left side and a right side with said seat cushion means having a length, said seat cushion means being made of at least three different materials having different densities, said first material having said first density being substantially rectangular shaped and occupying substantially all portions of said rectangular shape, said first material having a length greater than one-half said length of said seat cushion means, said length of said first material being defined between said front side and said rear side, said second material having said second density being disposed vertically above said first material, said second material having a length with said second material terminating along said length thereof at about the same termination of said length of said first material, said second material having a greater thickness at said front side of said seat cushion means than where said second material terminates, said third material having said third density extending from about where said first and second materials terminate, said third material being substantially rectangular shaped with the distance between said left and right sides of said seat cushion means having said third material being greater than the distance that said third material extends in a direction defined by the direction between said front side and said rear side of said seat cushion means;

back cushion means for supporting the back of the person in a substantially upright position;

first lateral trunk brace cushion means for bracing the right side of the person's torso in a substantially upright position;

second lateral trunk brace cushion means for bracing the left side of the person's torso in a substantially upright position; and means for interconnecting each of said seat cushion means, said back cushion means, said first lateral trunk brace cushion means and said second lateral trunk brace cushion means.

5. A method for providing support for a person in a substantially upright sitting position, comprising the steps of:

providing a plurality of seat cushion means with each of said plurality of seat cushion means being different from each other, each of said plurality of seat cushion means including a seat cushion and first interconnecting means affixed to said seat cushion;

providing a plurality of back cushion means with each of said plurality of back cushion means being different from each other, each of said back cushion means including a back cushion and second interconnecting means affixed to said back cushion and each of said back cushion means including lumbar support means with said lumbar support means being part of and permanently attached to different portion of said back cushion for each of said plurality of back cushions;

providing a plurality of first lateral trunk brace cushion means with each of said first lateral trunk brace cushion means for bracing the right side of the person's torso in a substantially upright position, each of said first lateral trunk brace cushion means including a first lateral trunk brace cushion and third interconnecting means affixed to said first lateral trunk brace cushion with each of said first lateral trunk brace cushion means being different from each other, each of said first lateral trunk brace cushions being substantially L-shaped with an upper level and a lower level, each of said first lateral trunk brace cushions means being provided separately from each of said plurality of seat cushion means and each of said plurality of back cushion means;

providing a plurality of second lateral trunk brace cushion means with each of said second lateral trunk brace cushion means for bracing the left side of the person's torso in a substantially upright position, each of said second lateral trunk brace cushion means including a second lateral trunk brace cushion and fourth interconnecting means with each of said plurality of second lateral trunk brace cushion means being different from each other and each of said plurality of second lateral trunk brace cushion means being different from each of said first lateral trunk brace cushion means, each of said second lateral trunk brace cushion being substantially L-shaped with an upper level and a lower level, each of said second lateral trunk brace cushion means being provided separately from each of said plurality of seat cushion means and each of said plurality of back cushion means;

determining selected dimensions of the person's body;

selecting one of said plurality of different seat cushion means for supporting the person while sitting;

selecting one of said plurality of different back cushion means having said lumbar support means in a desired position for the person in order to support the back of the person in a substantially upright position;

selecting one of said plurality of different first lateral trunk brace cushion means for bracing the right side of the person's torso in a substantially upright position with said selected one of said plurality of first lateral trunk brace cushion means not being selected from said plurality of second lateral trunk brace cushion means;

selecting one of said plurality of different second lateral trunk brace cushion means for bracing the left side of the person's torso in a substantially upright position, said selected one of said second lateral trunk brace cushion means not being selected from said plurality of first lateral trunk brace cushion means;

joining said selected one seat cushion means to said selected one back cushion means using portions of said first and second interconnecting means;

joining said selected one second lateral trunk brace cushion means to said selected one seat cushion means and to said selected one back cushion means using portions of said fourth interconnecting means, portions of said first interconnecting means and portions of said second interconnecting means;

joining said selected one first lateral trunk brace cushion means to said selected one seat cushion means and to said selected one back cushion means using portions of said third interconnecting means, portions of said first interconnecting means and portion of said second interconnecting means thereby forming an assembled support system;

placing said assembled system on a conventional support means; and locating said upper levels of each of said selected one first lateral trunk brace cushion means and said selected one second lateral trunk brace cushion means substantially adjacent to the axilla of each of the arms of the person when the person is supported by said assembled system.

* * * * *